US010036520B2

(12) United States Patent
Taylor

(10) Patent No.: US 10,036,520 B2
(45) Date of Patent: Jul. 31, 2018

(54) DECORATIVE LIGHTING SYSTEM

(71) Applicant: Darren Taylor, Lindon, UT (US)

(72) Inventor: Darren Taylor, Lindon, UT (US)

(73) Assignee: Axis Innovations, LLC, Lindon, UT (US)

( * ) Notice: Subject to any disclaimer, the term of this patent is extended or adjusted under 35 U.S.C. 154(b) by 377 days.

(21) Appl. No.: 14/813,936

(22) Filed: Jul. 30, 2015

(65) Prior Publication Data

US 2016/0047516 A1 Feb. 18, 2016

Related U.S. Application Data

(60) Provisional application No. 62/037,581, filed on Aug. 14, 2014.

(51) Int. Cl.

| | |
|---|---|
| ***F21S 8/00*** | (2006.01) |
| ***F21V 21/08*** | (2006.01) |
| ***F21S 4/20*** | (2016.01) |
| ***F21V 21/02*** | (2006.01) |
| ***F21S 4/10*** | (2016.01) |
| ***F21S 4/28*** | (2016.01) |
| *F21V 31/00* | (2006.01) |
| *F21W 121/00* | (2006.01) |
| *F21W 131/10* | (2006.01) |

(Continued)

(52) U.S. Cl.

CPC ..... *F21S 8/036* (2013.01); *F21S 4/10* (2016.01); *F21S 4/20* (2016.01); *F21S 4/28* (2016.01); *F21V 21/02* (2013.01); *F21V 21/08* (2013.01); *F21V 31/005* (2013.01); *F21W 2121/004* (2013.01); *F21W 2131/10* (2013.01); *F21Y 2113/17* (2016.08); *F21Y 2115/10* (2016.08)

(58) Field of Classification Search

CPC ..... F21S 4/10; F21S 4/20; F21S 4/28; F21S 8/036; F21S 21/08; F21V 21/02; F21V 31/005; F21W 2121/004; F21W 2131/10; F21Y 2113/17; F21Y 2115/10

See application file for complete search history.

(56) References Cited

U.S. PATENT DOCUMENTS

| | | | | |
|---|---|---|---|---|
| 6,422,717 B1 * | 7/2002 | Beadle | ..... | F21S 8/08 362/187 |
| 7,196,477 B2 * | 3/2007 | Richmond | ..... | F21S 9/037 315/149 |

(Continued)

*Primary Examiner* — Stephen F Husar

(74) *Attorney, Agent, or Firm* — Michael B. Dodd; Dodd Law Group

(57) ABSTRACT

The present invention extends to lighting system providing a year round, seasonal decorative lighting solution that is both customizable and essentially permanently installed. A light strand includes a plurality of lighting assemblies containing lighting elements and having posts with exterior attachment mechanisms. The lighting elements emit light through the post such that the light is externally visible. A post of each lighting assembly can be placed through a corresponding hole in a building feature (e.g., a gutter or flashing). In one aspect, the post is self-securing to the building feature. In another aspect, a cap is attached to each post (e.g., screwed or snapped) to secure the lighting assembly to the building feature. A lighting control device can individually address lighting assemblies to control lighting sequences, patterns, colors, hours of operation, etc. of the plurality of lighting assemblies.

22 Claims, 9 Drawing Sheets

(51) Int. Cl.
*F21Y 115/10* (2016.01)
*F21Y 113/17* (2016.01)

(56) References Cited

U.S. PATENT DOCUMENTS

2007/0223221 A1* 9/2007 George ..... F21V 21/088
362/249.01
2011/0090676 A1* 4/2011 Sortor ..... F21V 17/16
362/145

* cited by examiner

DECORATIVE LIGHTING SYSTEM

CROSS-REFERENCE TO RELATED APPLICATIONS

This application claims the benefit of U.S. Provisional Patent Application Ser. No. 62/037,581 entitled "Decorative Lights", filed Aug. 14, 2014 which is incorporated herein in its entirety.

BACKGROUND

Outdoor lights are a common decoration during the holiday season. They involve pulling out last year's lights from a box of other decorations (assuming you found the box), sorting each light strand and laying them out such that you can see what lengths you are dealing with. Each light strand is then tested to see what lights still work, and which ones don't. Caution is required to avoid breaking the delicate lights while they are evaluated, for example, by separating the strands and laying them out on the floor or ground.

Each one of the light stands is carefully placed on an edifice, for example, the roofline or gutter of a house, along its outline. A ladder can be used when placing each strand. Placing lights is often done during the winter, when weather conditions can make it difficult to work outside. This ritual is repeated year after year, and if the light strands are used more often than annually, the aggravation can be that much the worse.

BRIEF DESCRIPTION OF THE DRAWINGS

The specific features, aspects and advantages of the present invention will become better understood with regard to the following description and accompanying drawings where.

DETAILED DESCRIPTION

Figure 1A:
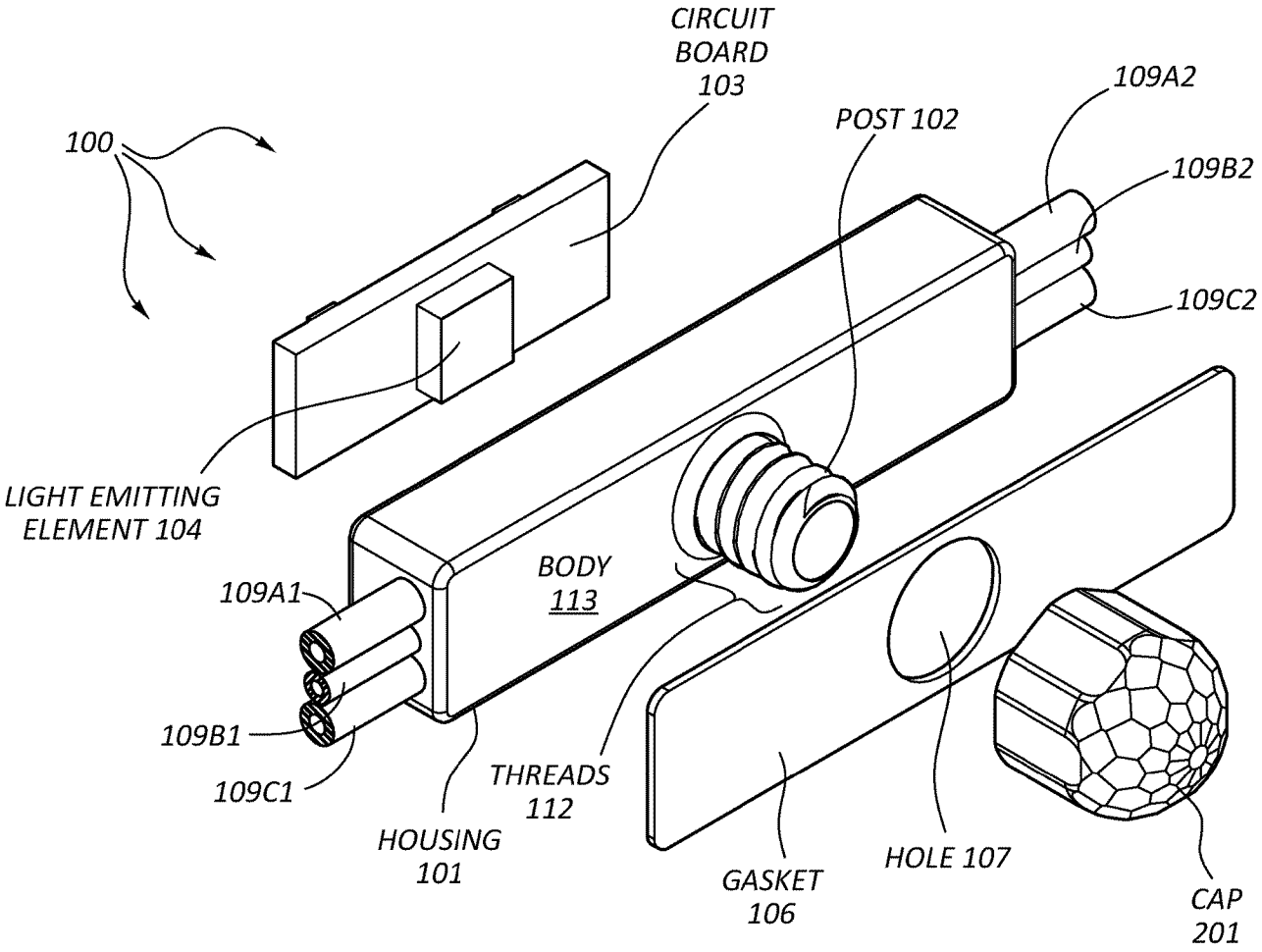
FIGS. 1A-1D illustrate an example lighting assembly that can be mounted in or on a building.

The present invention extends to a lighting system for applying and customizing permanent decorative lighting to edifices. In the following description of the present invention, reference is made to the accompanying drawings, which form a part hereof, and in which is shown by way of illustration a specific embodiment in which the invention may be practiced. It is understood that other embodiments may be utilized and structural changes may be made without departing from the scope of the present invention.

In general, embodiments of the invention include a strand of electrically coupled lighting assemblies. Each lighting assembly includes a housing configured to receive a circuit board and a light emitting element (e.g., a light emitting diode (LED)). Wires connect the circuit board to a power source and/or to circuit boards at other (e.g., adjacent) lighting assemblies in the strand. Each housing includes a post (potentially circular and/or threaded) that extends essentially perpendicularly away from a face of the housing.

The post can be constructed of a clear material that permits light to pass through. The post can include an attachment feature for securing the housing to a building feature (e.g., a rain gutter or flashing). In one aspect, the attachment feature self-secures to the building feature to attach the lighting assembly to the building feature. In another aspect, the attachment feature is configured to interoperate with a corresponding attachment feature of a cap to attach the lighting assembly to the building feature. For example, a post can include threads along at least part of the length of the post.

The post can be constructed from an essentially transparent material, a translucent (and possibly colored) material, or even a mostly opaque material. In one aspect, a threaded post is constructed from clear plastic.

The light emitting element is positioned within the housing such that, when powered, emitted light exits the housing through the post. As such, light emitted from inside a lighting assembly can be externally visible.

At a lighting assembly, a cap attachment mechanism can interoperate with a post attachment mechanism to secure the lighting assembly to a building feature, such as, a rating gutter or flashing. For example, the cap can include threads or can include some other attachment mechanism for snapping onto a post. In one aspect, the cap includes internal threads. The internal threads can be compatible with the threads on a threaded post. As such, a cap can be screwed onto to a threaded post to secure the cap to the threaded post.

The cap can be essentially transparent or possibly translucent (and even of different colors) permitting light to pass through. For example, the cap can be constructed from clear plastic In one aspect, a cap is designed to amplify light through the use of faceted cuts on a dome, giving the cap a rounded sloping or "hemispherical" appearance.

The length of wire between each lighting assembly in a strand can be essentially uniform such that posts on the lighting assemblies are essentially evenly spaced from one another when mounted. In one aspect, different wire is used between each set of adjacent lighting assemblies in a strand. In another aspect, a single continuous length of wire connects all the lighting assemblies in a strand. Other mixed and matched lengths of wire can also be used.

To prepare a building feature (e.g., a rain gutter or flashing) for a strand of electrically coupled lighting assemblies, holes can be made (e.g., drilled) into the building feature. The spacing between the holes can match the spacing between the posts on adjacent lighting assemblies. The diameter of each hole can be slightly larger than the diameter of a post so that a post can pass through the hole. However, the diameter of each hole can be smaller than the configuration of the end of the cap. Thus, when a cap is attached to (e.g., screwed onto) a post, the end of the cap can contact the building feature (pressing the building between the cap and the housing).

To mount a strand of electrically coupled lighting assemblies, the post of each lighting assembly can be passed through a hole in a building feature (e.g. rain gutter or flashing) so that the post points away from the building. In some aspects, an attachment feature on a post is self-securing to a building feature. For example, a post can be configured to snap fit to a hole for affixing a strand of lights to a building feature (e.g., a rain gutter or flashing). The end of the post that is to face away from the building can include a one way sloping feature that can pass through a hole in the building feature. Once through the hole, the sloping feature (not being sloped on the other side) prevents the post from passing back through the hole (and thus secures the housing to the building feature. In one aspect, the post includes a bulbous head that can be snapped through a hole in a building feature to provide attachment.

In other aspects, when a post passed through the hole in a building feature, a cap is attached to (e.g., screwed onto or snapped onto) the post to secure the cap to the housing. The diameter of the housing end of the cap cab be larger than the hole. Thus, attaching the cap to the post also secures the lighting assembly to the building feature (since the building feature is between the housing and the cap).

In some aspects, a gasket is positioned externally on the side of the housing including the post. The gasket can be constructed from any of a variety of materials including rubber, foam, etc. The gasket can have dimensions essentially equal to the side of the housing that includes the post. The gasket can also include a hole that is slightly larger than the post. The post can be passed through the hole in the gasket prior to passing the post through the hole a building feature. When secured to the building feature, the gasket compensates for any irregularities in the building feature so that the housing seals better against the building feature. A better seal helps keep water and debris from getting between the housing the building feature after installation.

Light emitting elements included in a housing can be configured for a specified purpose, for example, seasonal and non-seasonal decoration, outlining or illumination of buildings and other structures, aisles, streets, walkways, passageways, corridors, gangways, or other type of paths or constructions. The light emitting elements can be any color in the Red, Green, Blue (RGB) spectrum. The light emitting elements can be used to communicate a message and/or can be for aesthetic purposes.

In one aspect, a strand of electrically coupled lighting assemblies is attached to a rain gutter or flashing on the exterior of a building. The light emitting elements are protected within the housings. FIGS. 1A-1D illustrate an example lighting assembly 100 that can be mounted in or on a building. Turning to FIG. 1A, lighting assembly 100 includes housing 101, circuit board 103, and gasket 106

Housing 101 further includes body 113 and post 102. Post 102 can be constructed of solid clear plastic. Post 102 includes threads 112. Threads 112 are compatible with internal threads from a cap such that the cap can be screwed onto post 102. Gasket 106 (e.g., a foam gasket) incudes hole 107. Post 102 can be inserted though hole 107 to place gasket 106 in contact with body 113.

Circuit board 103 includes light emitting element 104 (e.g., an LED). Circuit board 103 can also include electronic circuitry for handling instructions from a lighting controller device. Instructions from a lighting controller device can include turning power on or off, changing the color of light emitted from light emitting element 104, etc. Circuit board 103 can be positioned within body 113 so that light emitted from light emitting element 104 is emitted through post 102 to exit housing 101. As such, light emitted from light emitting element 114 can be externally visible.

Once positioned, circuit board 103 can be secured inside body 113 (e.g., with epoxy resin, fasteners, screws, other adhesive, etc.). Securing circuit board 103 can include making electrical connections between circuit board 103 and wires 109A1, 109B1, 109C1, 109A2, 109B2, and 109C2. Making electrical connections can include soldering wires 109A1, 109B1, 109C1, 109A2, 109B2, and 109C2 to electrical contacts on circuit board 103. Alternately, making electrical connections can include making mechanical connections between electrical contacts on circuit board 103 and electronic contacts on connectors inside body 113 (that are in turn connected to wires 109A1, 109B1, 109C1, 109A2, 109B2, and 109C2). After circuit board 103 is secured within housing 101, any remaining space inside body 113 can be filled with epoxy resin. When dried, the epoxy resin provides an essentially water proof seal to protect circuit board 103 and light emitting element 104.

Thus, within body 113, circuit board 103 can be connected to wires 109A1, 109B1, 109C1, 109A2, 109B2, and 109C2. Wires 109A1 and 109A2 are associated the same electrical pathway as it passes through circuit board 103. Similarly, wires 109B1 and 109B2 are associated with the same electrical pathway as it passes through circuit board 103. Likewise, wires 109C1 and 109C2 are associated with the same electrical pathway as it passes through circuit board 103.

Wires 109A1, 109B1, 109C1, 109A2, 109B2, and 109C2 connect circuit board 103 to one or more of: circuit boards in other lighting assemblies, to a power source, to a lighting controller device, etc. Wires used for different electrical pathways can be of the same gauge or of different gauges (e.g., ranging from 10 to 28 gauge) and can be stranded or solid. In one aspect, electrical power (e.g., for energizing light emitting element 104) flows through two electrical pathways, such as, for example, a pathway associated with wires 109A1 and 109A2 and a pathway associated with wires 109C1 and 109C2. In this one aspect, control signals from a lighting controller device (either directed to circuit board 103 or directed to another circuit board) are received on a pathway associated with wires 109B1 and 109B2.

Figure 1B:
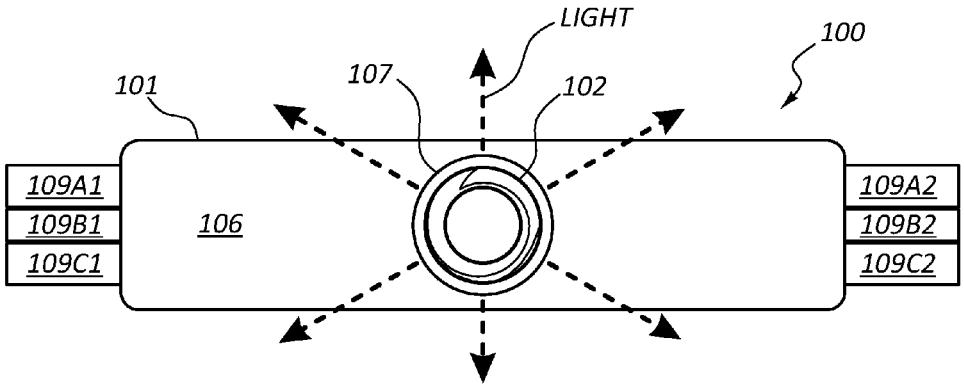

Turning to FIG. 1B, FIG. 1B depicts a top view of lighting assembly 100. As depicted, gasket 106 covers the face of housing 101 that includes post 102. The diameter of hole 107 is somewhat larger than the diameter of post 102. When light emitting element 104 is energized, the generally direction of emitted light is outward from post 102 (in FIG. 1B this would be both radially and out of the page).

Figure 1C:
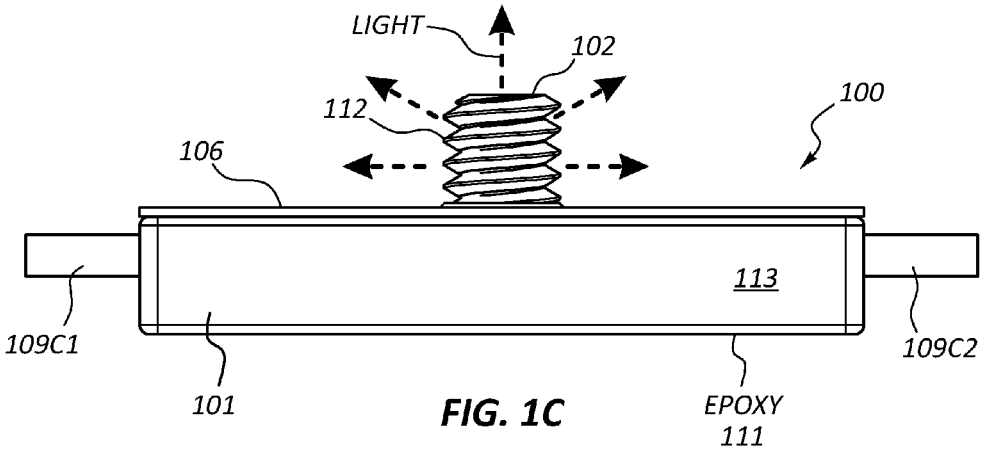
Figure 1D:
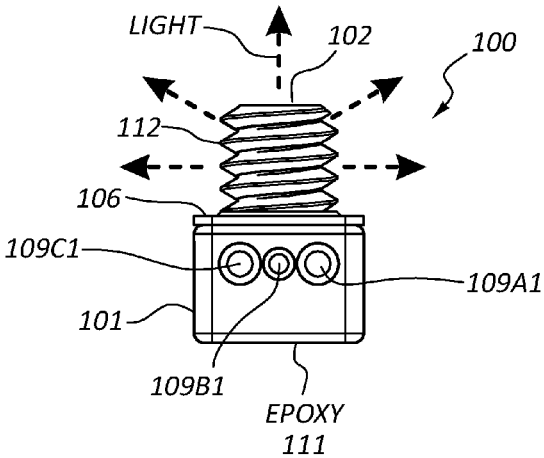

Turning to FIG. 1C, FIG. 1C depicts a side view of lighting assembly 100. As depicted, gasket 106 covers the side of housing 101 that includes post 102. Epoxy 111 can be partially external to body 113. The arrows indicate the general directions of emitted light when light emitting element 104 is energized Turning to FIG. 1D, FIG. 1D depicts an end view of lighting assembly 100. Similar to FIG. 1C, gasket 106 is depicted as covering the face of housing 101 that includes post 102. Epoxy 111 can be partially external to body 113. The arrows indicate the general directions of emitted light when light emitting element 104 is energized.

Figure 2A:
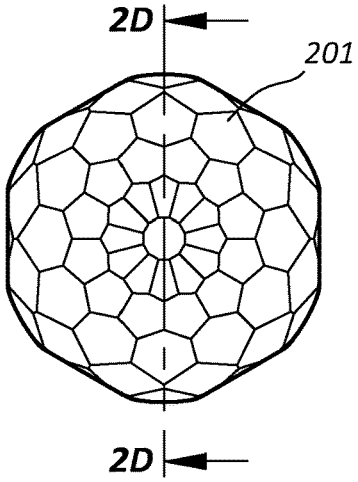
FIGS. 2A-2F illustrate an example cap for distributing light from a lighting assembly.
Figure 2B:
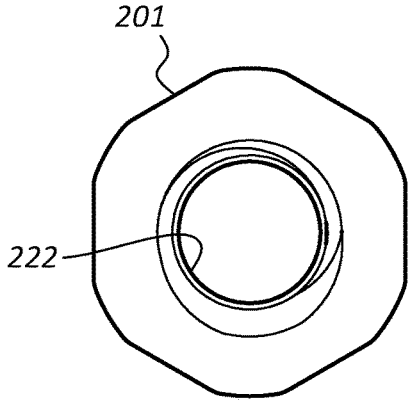

FIGS. 2A-2F illustrate an example cap 201 for distributing light from a lighting assembly. Turning to FIG. 2A, FIG. 2A shows a top view of cap 201. Cap 201 includes a variety of cuts on a geodesic dome. These cuts can be configured to disperse and amplify light through refraction. Turning to FIG. 2B, FIG. 2B shows a bottom view of cap 201. As depicted, cap 201 includes hollow portion 323 having threads 222. Threads 222 are configured to accept threads from a lighting assembly post (e.g., post 102). The bottom of cap 201 can configured so that at least parts of cap 201 extend out past the diameter of any hole a lighting assembly post is passed through.

Figure 2C:
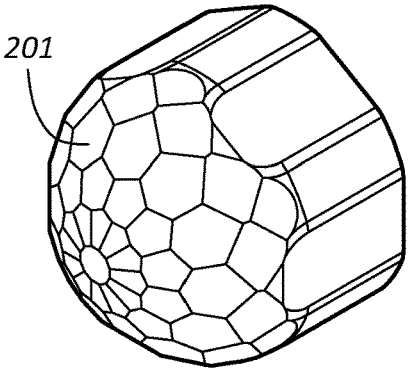
Figure 2D:
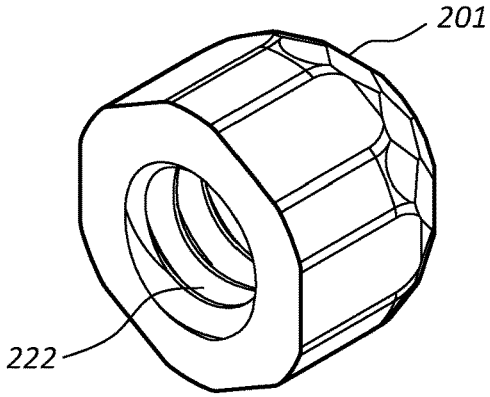

FIGS. 2C and 2D depict different perspective views of cap 201.

Figure 2E:
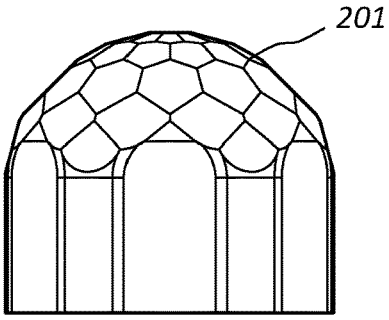
Figure 2F:
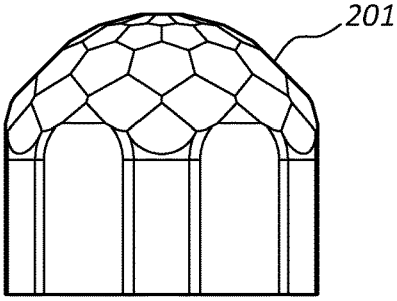

FIGS. 2E and 2F depict different side views of cap 201.

Figure 5:
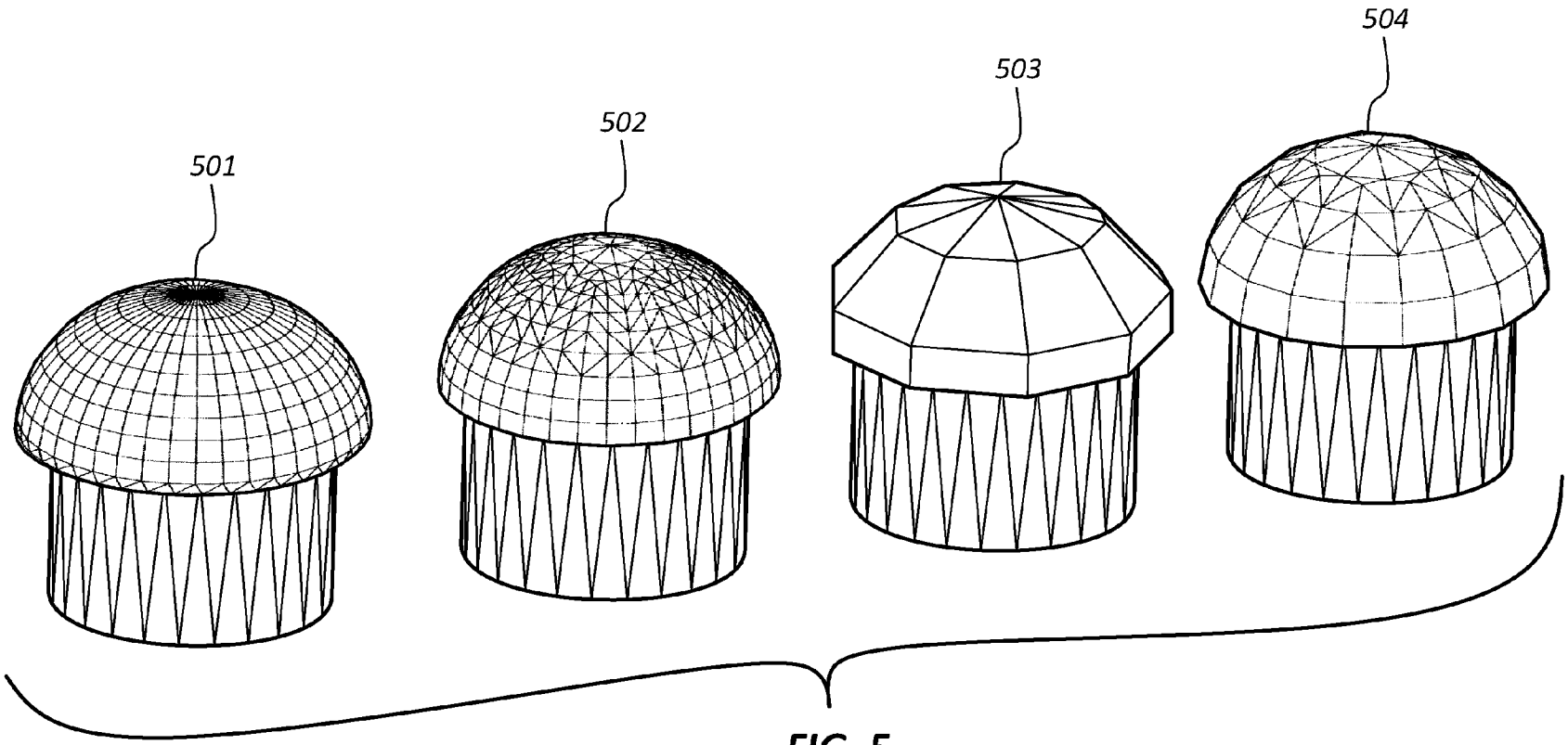
FIG. 5 illustrates wireframe examples of cap faceting options.

Other configurations of caps are also possible and different configurations of caps can be used to disperse and amplify light in differ ways. Turning briefly to FIG. 5, FIG. 5 illustrates wireframe examples of different cap faceting options 501, 502, 503, and 504 on a geodesic dome.

Figure 3A:
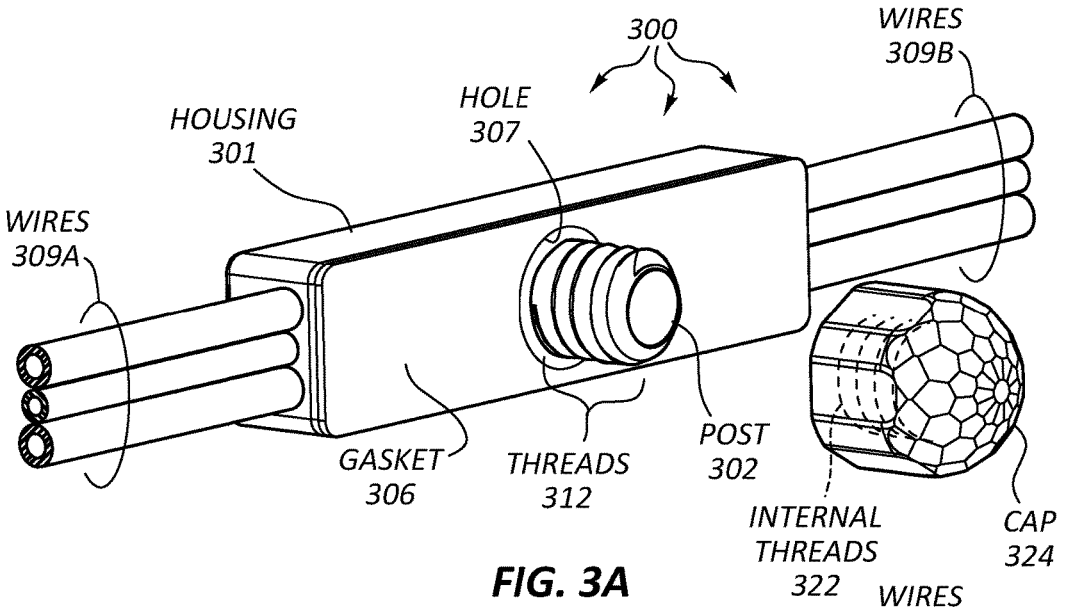
FIGS. 3A-3C illustrate an example lighting assembly and corresponding cap.
Figure 3B:
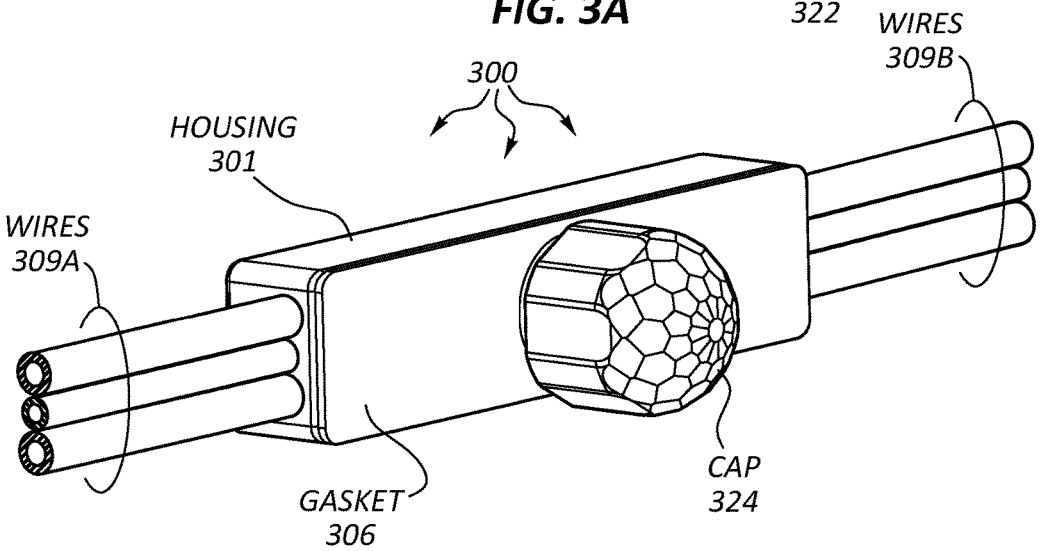
Figure 3C:
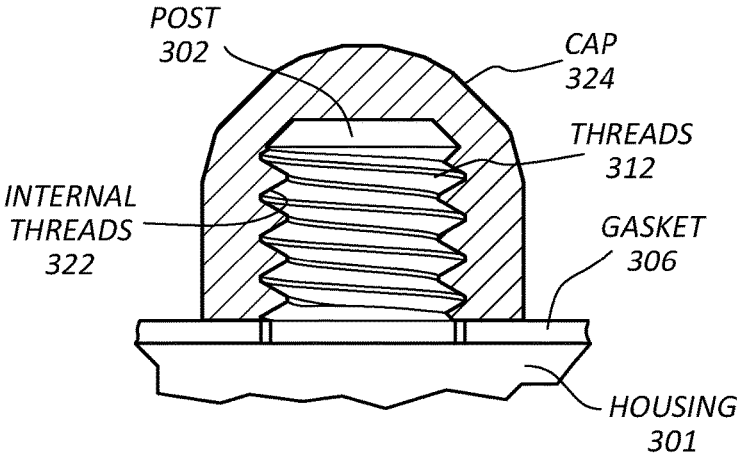

Moving to FIGS. 3A-3C, FIGS. 3A-3C illustrate an example lighting assembly 300 and corresponding cap 321. As depicted, housing 301 includes body 313 and post 302. Gasket 306 is on the post side of body 313. The diameter of hole 307 is large enough so that post 302 can fit through hole 307. Wires 309A and 309B connect lighting assembly 300 to power and/or to other components. A light emitting element (not shown) can be contained inside body 313.

Post 302 is constructed of an essentially clear material and includes threads 312. Cap 321 is also constructed of an essential clear material and includes internal threads 322. Threads 312 and internal threads 322 are compatible with one another such that cap 321 can be screwed onto post 302. Turning to FIG. 3B, FIG. 3B depicts cap 321 screwed onto post 302. Light from the light emitting element contained inside body 313 can be emitted through hollow portion 314, through post 302, and through cap 321. As such, light emitted from the light emitting element contained inside body 313 is externally visible.

Materials and configurations (e.g., cuts on cap 321) used for post 302 and cap 321 can be varied for different lighting effects.

Turning to FIG. 3C, FIG. 3C depicts a sectional view of cap 321 screwed onto post 302. The arrow indicates the general direction of emitted light from the light emitting element contained inside body 313.

In one aspect, a plurality of lighting assemblies is electrically coupled together into a strand. A strand can be installed on an external feature of a building, such as, for example, a rain gutter or flashing.

In some embodiments, an installation kit can include a measured (e.g., pre-measured) layout tape (e.g., masking tape). The measured layout tape adheres to the edge of rain gutters or flashing and indicates locations where holes are to be placed in rain gutters or flashing to receive the posts from the lighting assemblies. The tape can be pre-measured to locate holes at specified (and either varied or consistent) intervals, such as, for example, every six inches, every nine inches, every 12 inches, etc. The specified intervals can be configured to match the distances between posts based on the length of wire between adjacent lighting assemblies and housing body dimensions. The tape can be centered and holes can be cut, for example, using an appropriately sized drill bit, such as, ¼' drill bit, ⅜" drill bit, etc., at each indicated hole location on the measured layout tape. The posts can then be pushed through the holes from the backside of the gutter or flashing to make the threads or other connection features available.

Figure 4A:
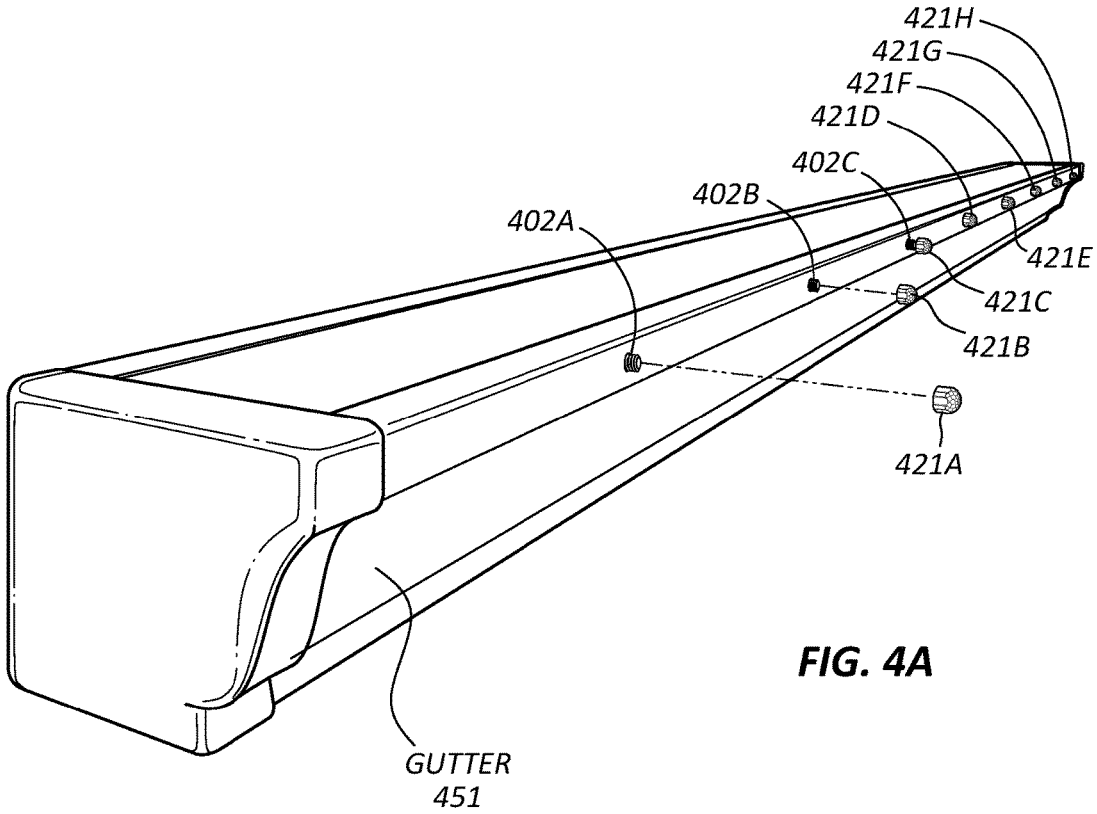
FIGS. 4A-4C illustrate an example of installing a strand of lighting assemblies on a rain gutter.
Figure 4B:
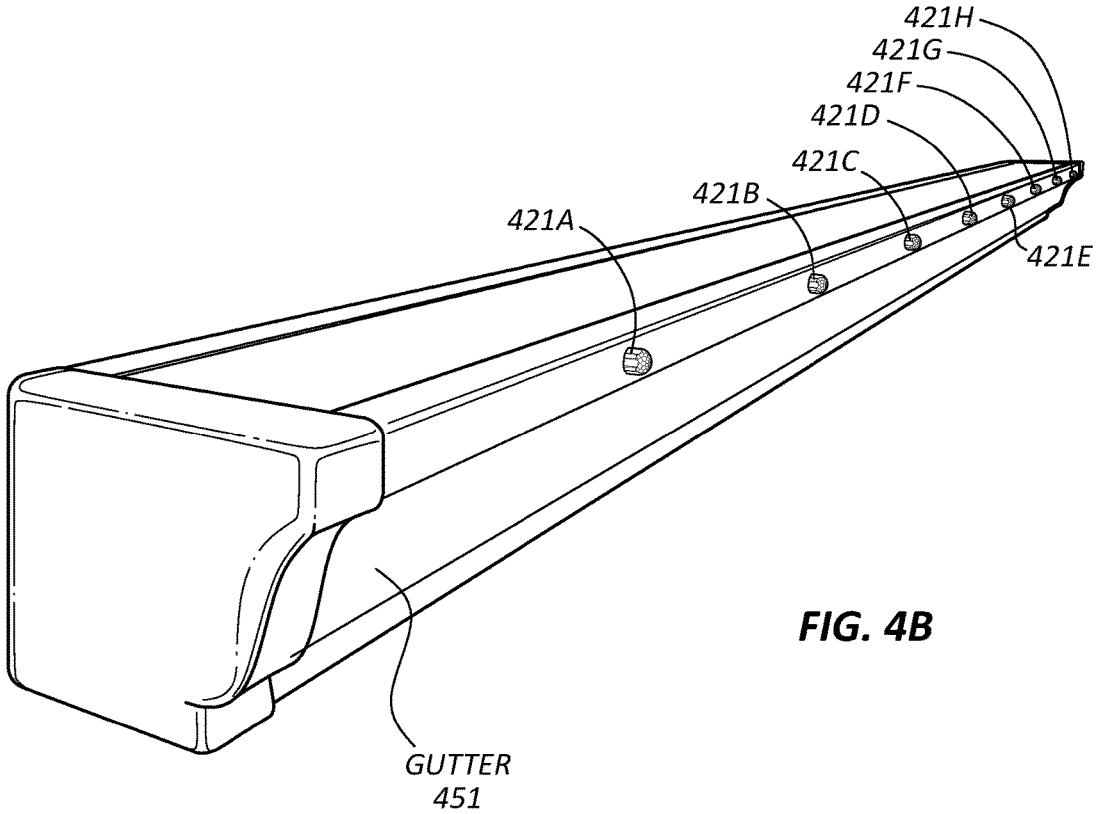
Figure 4C:
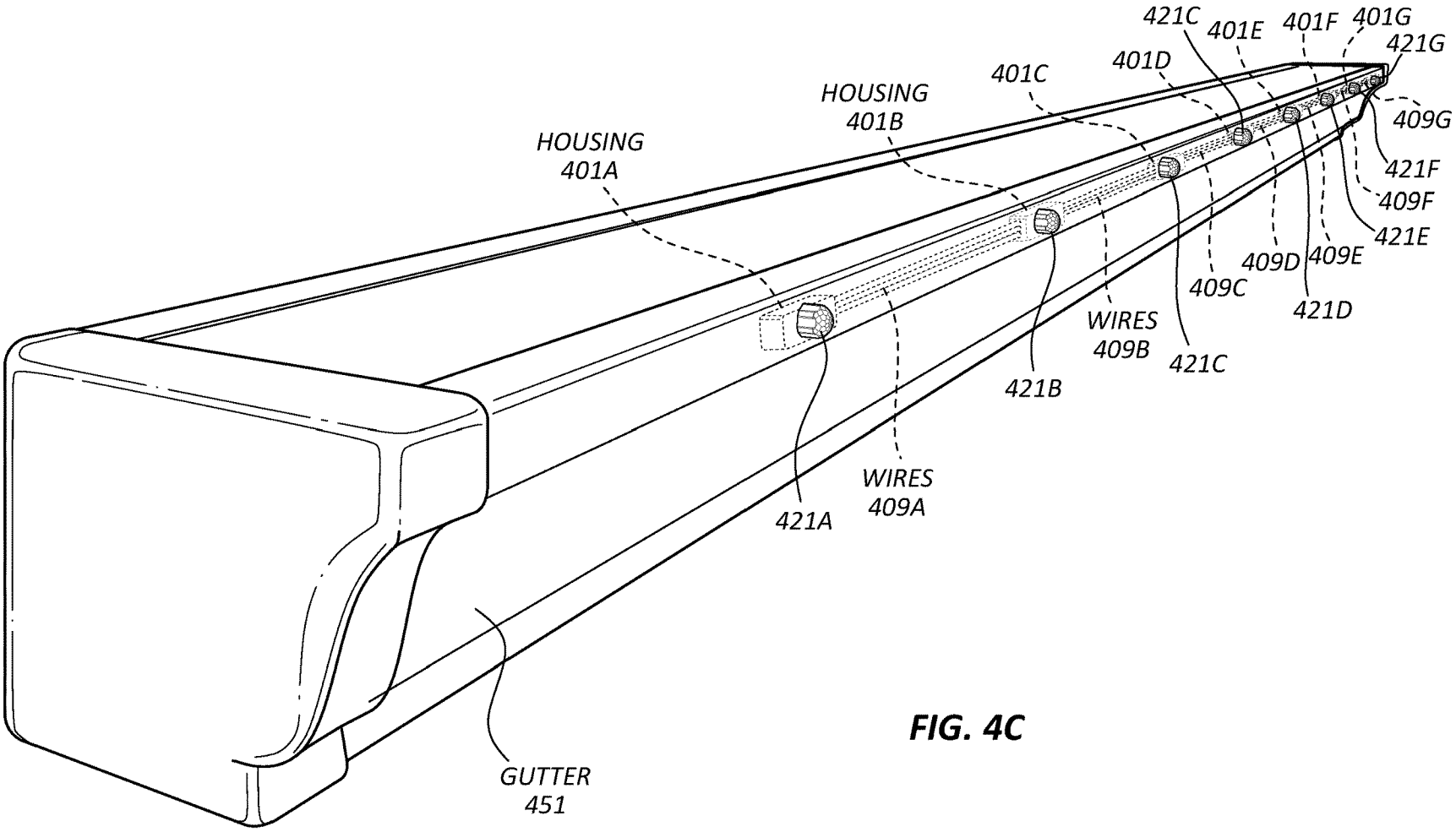

FIGS. 4A-4C illustrate an example of installing a strand of lighting assemblies on a rain gutter 451. Turning to FIG. 4A, lighting assembly posts 402A, 402B, 402C, etc., are passed through holes in gutter 451. Corresponding caps 421A, 421B, and 421C are depicted some distance away from light assembly posts 402A, 402B, and 402C respectively. Caps 421D, 421E, 421F, 421G, and 421H are depicted as already being screwed onto corresponding light assembly posts. Turning to FIG. 4B, caps 421A, 421B, and 421C are depicted as being screwed onto lighting assembly posts 402A, 402B, and 402C respectively.

Turning to FIG. 4C, gutter 451 is depicted as transparent so that the other components of the strand of lighting assemblies are visible. In FIG. 4C, housings 401A-401H are also shown. Housings 401A-401H are electrically connected to one another by wires 409A-409G. In general, screwing the cap onto the associated post secures the corresponding housing to gutter 451. For example, screwing cap 421A onto post 402A secures housing 401A to gutter 451, etc. A gasket on the post side of each housing helps ensure that there is a sufficient seal (no gap) between the housing and gutter 451. A sufficient seal can significantly reduce the likelihood for water and/or debris to settle between the housing and the gutter.

Figure 7:
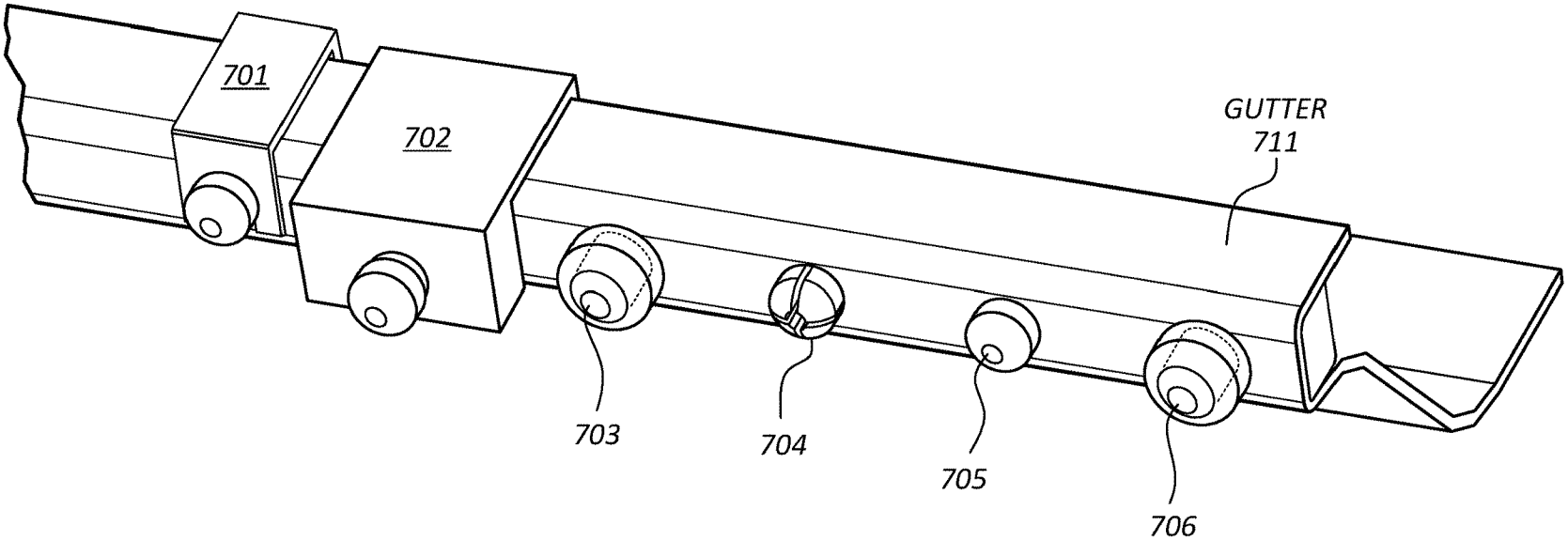
FIG. 7 illustrates example attachment mechanisms for attaching a lighting assembly to a building feature.

Turning to FIG. 7, FIG. 7 illustrates example attachment mechanisms for attaching a lighting assembly to a building feature (e.g., a rain gutter of flashing). Attachment mechanism 701 uses a smooth post with a groove in the sides that a clip can slide into to prevent the post from going back through the gutter. As depict, attachment mechanism over the top of gutter 711 similar to a clip. Attachment mechanism 701 can also be somewhat smaller like a U shaped washer.

Attachment mechanism 702 clips onto the gutter eliminating the need for a hole.

Attachment mechanism 703 includes a threaded post and threaded cap (similar to FIGS. 4A-4C).

Attachment mechanism 704 includes a plus cut the post. The plus cut permits the post to compress when going through a hole. Once through the hole, the plus cut portion of the post then re-expands. (This is a single piece assembly).

Attachment mechanism 705 includes a mushroom shape post. The angle of the mushroom shape in combination with the flexibility of gutter 711 permits attachment mechanism 705 to through a hole. Once through the hole, the back side prevents attachment mechanism 705 from going back through the hole. (This is a single piece assembly).

Attachment mechanism 706 is similar to attachment mechanism 704 but without threads. In attachment mechanism 706, a cap snaps into place on a post. The cap can include extrusions that fit into groves on the post. The post can include groves at different lengths to all the cap snap fit into different places depending on the thickness of gutter 711.

Attachment mechanisms 701-706 or similar mechanism can also be used to attach a lighting assembly to flashing.

Accordingly, the post of a lighting assembly housing facilitates at least two beneficial purposes. A post provides a pathway for emitted light to emit outside of the corresponding housing such that the emitted light is externally visible. An attachment feature, for example, exterior threads, provides a mechanism for securing the lighting assembly (relatively permanently) to a feature of a building. A cap and gasket can protect the circuit board and light emitting element inside a housing from damage due to water and debris.

The strand can be connected to a Wi-Fi hub box, providing power and control using installed firmware. In one embodiment, the hub box is installed in a domicile garage. The Wi-Fi hub box can include an internal power supply or be connected to external power, and in turn powers the strand. In some aspects, the Wi-Fi hub box is connected to on outlet with GFCI protection.

In some aspects, a strand is 25 feet or greater in length. In one aspect, multiple strands are joined electrically by provided jumpers and by a mechanical coupler that makes the strands one piece and protects against environmental factors, such as rain. The system has the capacity to connect hundreds of linear feet (e.g., 500 linear feet, 750 linear feet, etc.)

of lights in series. A mechanical coupler can comprise a low profile, rubber and/or plastic sleeve.

Customization of the light color, sequence, and illumination can be configured via a software application on a mobile device platform (such as, but not limited to, Android or iOS). This application controls the color of each light emitting element in the RGB spectrum, and communicates with the hub box by Wi-Fi. The interface allows for the selection of colors and patterns. The application also provides pre-programmed color schemes and patterns for different holidays. The user interface (UI) also has a calendar function to set days and times for the lights to operate. Selectable patterns include, but are not limited to, fade, twinkle, chase, blinking, and can be applied to sections of lights or individual lights. All network controls and locks are done via the application.

Figure 6:
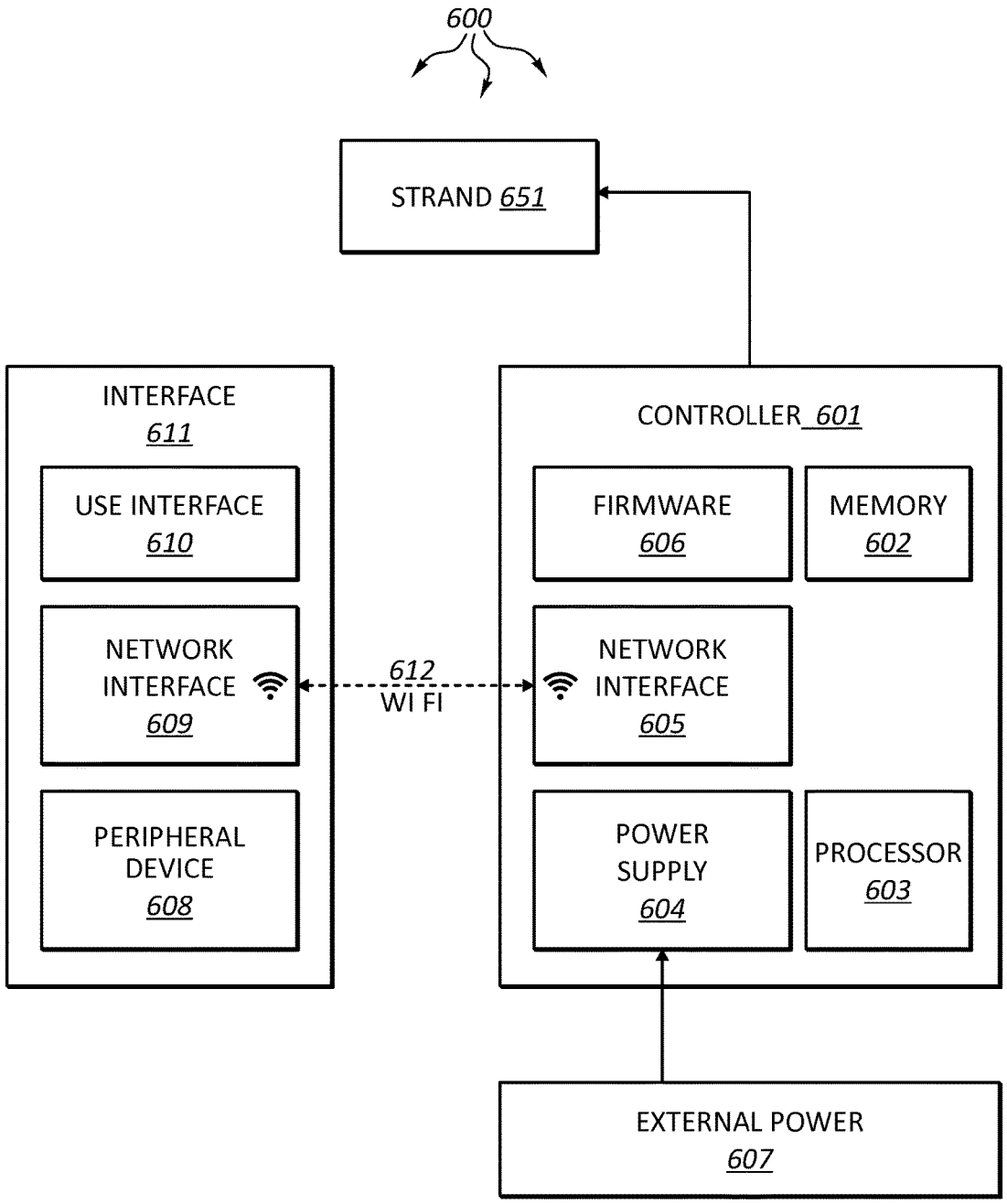
FIG. 6 illustrates an example architecture for controlling a strand of lighting assemblies.

Turning to FIG. 6, FIG. 6 illustrates can example architecture 600 for controlling a strand of lighting assemblies. As depicted, strand 651 is connected to controller 601. Controller 601 is electrically connected to external power 607 and via Wi-Fi 612 to the interface 611. Controller 601 includes firmware 606, memory 602, processor 603, power supply 604, and network interface 605. Interface 611 includes user Interface 610, network interface 609, and peripheral device 608. Peripheral device 608 can be any mobile device that operates an application used to interface with controller 601. The two units (controller 601 and interface 611) communicate via Wi-Fi 612 between the network interfaces 605 and 609. Using interface 611, peripheral device 608 can program controller 601 with various and assorted lighting schemes (schedule of operation, timing sequences, patterns, color changes, etc.) to be implemented on per lighting assembly basis for strand 651. That is, each lighting assembly in a strand can be individually addressable. Thus, an application ("app") at a mobile device can be used to control the color, patterns, and schedule of operation for each lighting assembly individually. During operation, memory 602, processor 603, and firmware 606 can interoperate to implement programmed lighting schemes on strand 651

In some embodiments, lighting elements rated for greater than 50,000 hours are used in each lighting assembly. As such, maintenance and repeat setup are minimized for the products life span.

Accordingly, embodiments of the invention provide a longer lasting lighting solution that does not require periodic physical removal and setup. The lights are also easily customizable through use of a mobile device. Attaching a cap onto a lighting assembly post protruding through a hole in a gutter or flashing facilities a relatively secure mechanical coupling between the lighting assembly and the gutter or flashing. As such, aspects of the invention provide an essentially permanent decorative light solution that does not need periodic installation, and can be customized with virtually any mobile device. Since the body is hidden behind a building feature (e.g., a rain gutter or flashing), the externally visible portion of a strand is posts and possibly (depending on the attachment mechanisms) caps. These components are relatively small and are not visible distracting when left up year round.

The described aspects may be implemented in other specific forms without departing from its spirit or essential characteristics. The described aspects are to be considered in all respects only as illustrative and not restrictive. The scope is, therefore, indicated by the appended claims rather than by the foregoing description. All changes which come within the meaning and range of equivalency of the claims are to be embraced within their scope.

What is claimed:

1. A lighting assembly comprising:

a body;

a translucent post extending from the body and including an attachment component configured to interoperate with a corresponding attachment component included on a cap to attach the body to a structure; and a light emitting element contained inside the body and positioned to emit light outside the body through the translucent post.

2. The lighting assembly of claim 1, wherein the translucent post including an attachment component configured to interoperate with a corresponding attachment component included on a cap comprises the translucent post including external threads compatible with corresponding threads included on the cap.

3. The lighting assembly of claim 1, the translucent post further comprising a hollow portion; and wherein the light emitting element positioned to emit light through the translucent post comprises the light emitting element positioned to emit light through the hollow portion.

4. The lighting assembly of claim 1, further comprising a gasket configured to seal between the body and the structure when the body is attached to the structure.

5. The lighting assembly of claim 1, further comprising the cap attached to the translucent post to physically cover a hollow portion of the translucent post.

6. The lighting assembly of claim 5, wherein the cap is constructed of essentially clear plastic.

7. The lighting assembly of claim 5, wherein the cap includes a multi-faceted geodesic dome for refracting light emitted through the hollow portion of the translucent post.

8. The lighting assembly of claim 1, wherein the translucent post is constructed of essentially clear plastic.

9. The lighting assembly of claim 1, wherein the light emitting element comprises a Light Emitting Diode (LED) capable of emitting lighting of a plurality of different colors.

10. A lighting assembly comprising:

a body;

a post extending from the body, the post including an attachment component compatible with a corresponding cap attachment component included in a cap;

a light emitting element contained inside the body and positioned to emit light outside the body through the post; and a gasket configured to seal between the body and a structure when the body is attached to the structure.

11. The lighting assembly of claim 10, further comprising:

a circuit board contained in the body.

12. The lighting assembly of claim 11, further comprising three wires electrically connecting the circuit board to another electrical device, two of the three wires configured to provide power to the circuit board and the lighting element and one of the three wires configured to transfer control signals from a lighting controller device.

13. The lighting assembly of claim 10, further comprising:

the cap attached to the post to secure the body to a structure.

14. The lighting assembly of claim 10, wherein the light emitting element comprises a Light Emitting Diode (LED) capable of emitting light of a plurality of different colors.

15. A lighting system comprising:

a plurality of lighting assemblies, each lighting assembly including:

a body, a post, and a light emitting element post including threads and a hollow portion, the light emitting element positioned inside the body to emit light outside the body at least through the hollow portion of the post, the threads compatible with corresponding threads of a cap, the cap for physically covering the hollow portion of the post;

a lighting control device configured to individually address each of the plurality of lighting assemblies; and electrical connections between adjacent lighting assemblies of the plurality of lighting assemblies, the electrical connections configured to provide power to the plurality of lighting assemblies and to transfer control signals from the lighting control device.

16. The lighting system of claim 15, further comprising for each lighting assembly:

a gasket configured to seal between the body and a structure when the body is attached to the structure.

17. The lighting system of claim 15, wherein the lighting element in each lighting assembly comprises a Light Emitting Diode (LED) capable of emitting lighting of a plurality of different colors.

18. A lighting assembly comprising:

a body;

a translucent post extending from the body and including an attachment component configured to directly attach to a structure; and a light emitting element contained inside the body and positioned to emit light outside the body through the translucent post.

19. The lighting assembly of claim 18, the translucent post further comprising a hollow portion; and wherein the light emitting element positioned to emit light through the translucent post comprises the light emitting element positioned to emit light through the hollow portion.

20. The lighting assembly of claim 18, further comprising a gasket configured to seal between the body and the structure when the body is attached to the structure.

21. The lighting assembly of claim 18, wherein the translucent post is constructed of essentially clear plastic.

22. The lighting assembly of claim 18, wherein the light emitting element comprises a Light Emitting Diode (LED) capable of emitting lighting of a plurality of different colors.

* * * * *